US008845447B2

(12) United States Patent
Gardiner et al.

(10) Patent No.: US 8,845,447 B2
(45) Date of Patent: Sep. 30, 2014

(54) GOLF PUTTER ATTACHMENT TO LIFT GOLF BALLS AND TO PROP GOLF PUTTERS

(71) Applicants: William Gardiner, Windsor (CA); Timothy Carr, Haines City, FL (US)

(72) Inventors: William Gardiner, Windsor (CA); Timothy Carr, Haines City, FL (US)

( * ) Notice: Subject to any disclaimer, the term of this patent is extended or adjusted under 35 U.S.C. 154(b) by 79 days.

(21) Appl. No.: 13/781,730

(22) Filed: Feb. 28, 2013

(65) Prior Publication Data

US 2013/0225310 A1 Aug. 29, 2013

Related U.S. Application Data

(60) Provisional application No. 61/604,591, filed on Feb. 29, 2012.

(51) Int. Cl.
*A63B 47/02* (2006.01)

(52) U.S. Cl.
USPC ..... 473/282; 473/285; 473/286

(58) Field of Classification Search
CPC .... A63B 47/02; A63B 2047/02; A63B 55/10; A63B 57/0075
USPC ..... 473/282, 286, 285
See application file for complete search history.

(56) References Cited

U.S. PATENT DOCUMENTS

| | | | | |
|---|---|---|---|---|
| 2,700,547 | A * | 1/1955 | Kraeling, Jr. | 473/285 |
| 2,801,875 | A * | 8/1957 | McEvoy | 294/19.2 |
| 2,819,108 | A * | 1/1958 | Borah | 294/19.2 |
| 4,693,473 | A * | 9/1987 | Miller | 294/19.2 |
| 5,330,177 | A * | 7/1994 | Rogge | 473/386 |
| 5,795,249 | A * | 8/1998 | Johnson | 473/406 |
| 6,824,179 | B1 * | 11/2004 | Shelato | 294/19.2 |
| 7,588,040 | B1 * | 9/2009 | Chen et al. | 135/16 |
| 7,951,014 | B2 * | 5/2011 | Nickel | 473/286 |
| 2003/0083142 | A1 * | 5/2003 | Nam | 473/286 |
| 2006/0058109 | A1 * | 3/2006 | Wilson, III | 473/286 |

FOREIGN PATENT DOCUMENTS

GB 2441823 A * 3/2008 ..... A63B 47/02

* cited by examiner

*Primary Examiner* — Stephen L. Blau

(57) ABSTRACT

The golf putter attachment is an apparatus that is able to grasp golf balls from hard-to-reach places and is able to prop up the grip of a golf putter. The apparatus includes a grip insert, two separate bodies, a locking mechanism, a hinge, a thumbnail opener, a suction cup, and a ball marker. The grip insert attaches the apparatus to a golf putter. The suction cup is used to grasp a golf ball by using the full length of a golf putter. The locking mechanism allows the two bodies to attach and detach from each other, which allows the two bodies to reconfigure themselves and prop up the golf putter. The thumbnail opener can separate the two bodies, and the hinge keeps the two bodies adjoined while the two bodies are separated. The ball marker is detachable component used to mark the location of a golf ball during a game.

14 Claims, 5 Drawing Sheets

GOLF PUTTER ATTACHMENT TO LIFT GOLF BALLS AND TO PROP GOLF PUTTERS

The current application claims a priority to the U.S. Provisional Patent application Ser. No. 61/604,591 filed on Feb. 29, 2012.

FIELD OF THE INVENTION

The present invention relates generally to an apparatus for a golf ball retriever. More specifically, the present invention is an apparatus that holds a golf ball with a suction cup, screws into a golf grip, opens on a hinge keeping the grip off of the wet turf, and also holds a ball marker.

BACKGROUND OF THE INVENTION

There are also many situations in which the golfer needs to lay down his or her golf club. In wet conditions, unfortunately, this results in the golf club getting wet, which can damage the club and makes the club harder for the golfer to grip.

It is therefore an object of the present invention to provide a golf ball holder that screws into a golf club grip. It is a further object of the present invention to provide a hinge on the device that allows the golfer to stand up the golf club grip so that the grip does not get in the water when the golfer lays down the club.

DETAIL DESCRIPTIONS OF THE INVENTION

All illustrations of the drawings are for the purpose of describing selected versions of the present invention and are not intended to limit the scope of the present invention.

Figure 1:
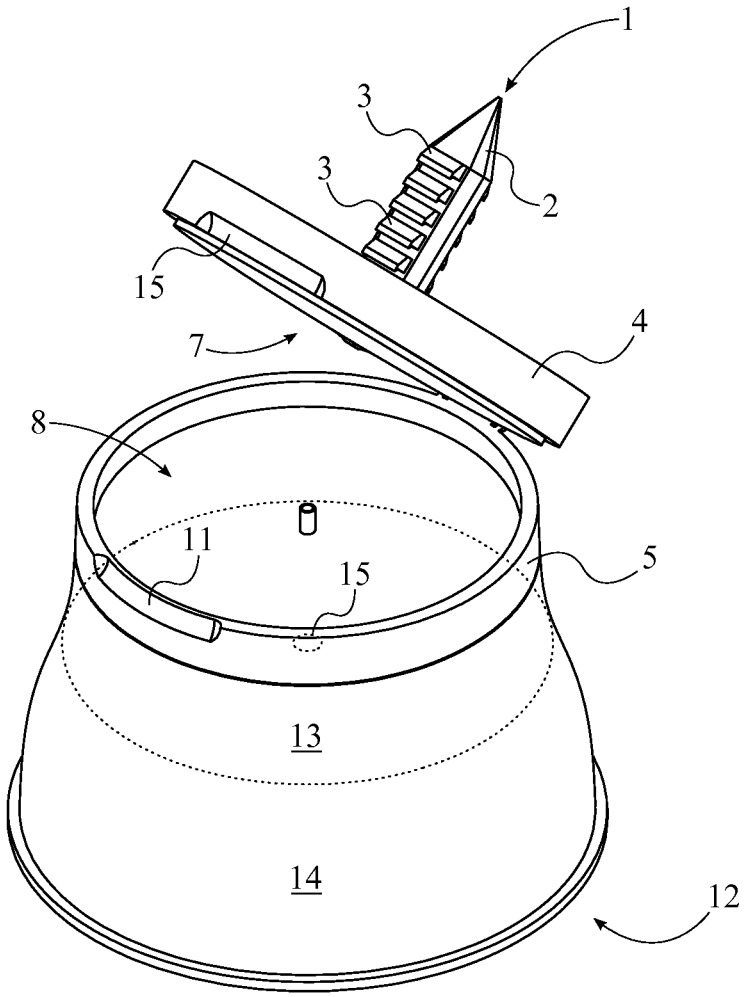
FIG. 1 is a top perspective view of the present invention, wherein the present invention is partially open.

As can be seen from FIG. 1, the present invention is a golf putter attachment to lift golf balls and to prop up golf putters, which allows a user to perform a variety of utilities that are related to golf balls. The present invention mainly comprises a grip insert 1, a first body 4, a second body 5, a locking mechanism 6, a hinge 9, a thumbnail opener 11, a suction cup 12, and a ball marker 16. The first body 4 and the second body 5 are the structural components of the present invention, which are used position and configure the other components of the present invention. The grip insert 1 allows the present invention to attach to a typically golf putter. The suction cup 12 allows the present invention to grasp a golf ball from a golf cup hole or to fetch a golf ball from other hard-to-reach places. The ball marker 16 is a detachable component of the present invention and is used to mark the location of a golf ball during the course of a game. The locking mechanism 6 is used to couple the first body 4 and the second body 5. The thumbnail opener 11 is used to disengage the locking mechanism 6 and reconfigure the positioning of the first body 4 from the second body 5 as a means to prop the grip of the golf putter off the ground. The hinge 9 allows the first body 4 to stay attached to the second body 5 while the locking mechanism 6 is disengaged.

Figure 2:
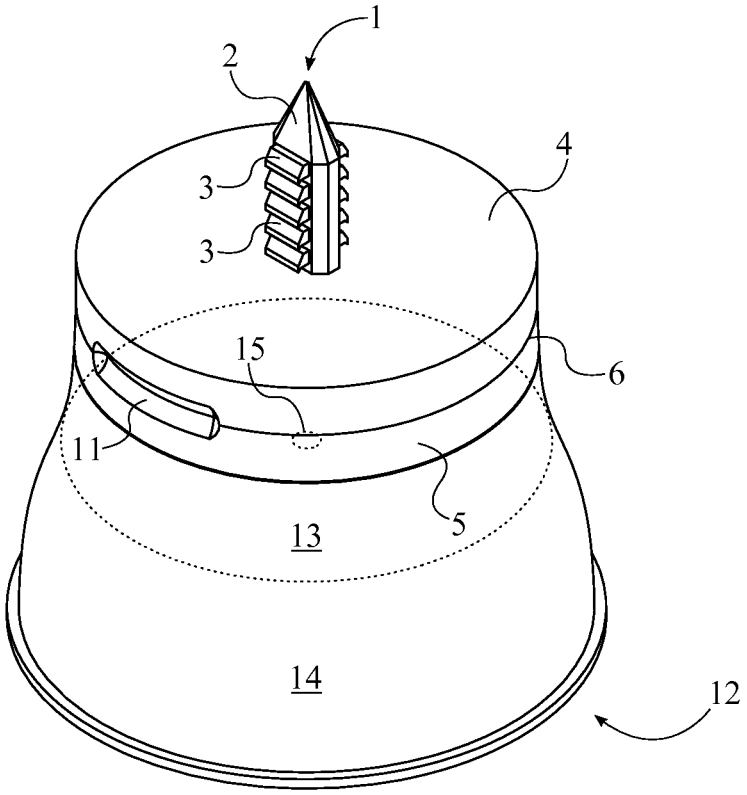
FIG. 2 is a top perspective view of the present invention, wherein the present invention is fully closed.
Figure 3:
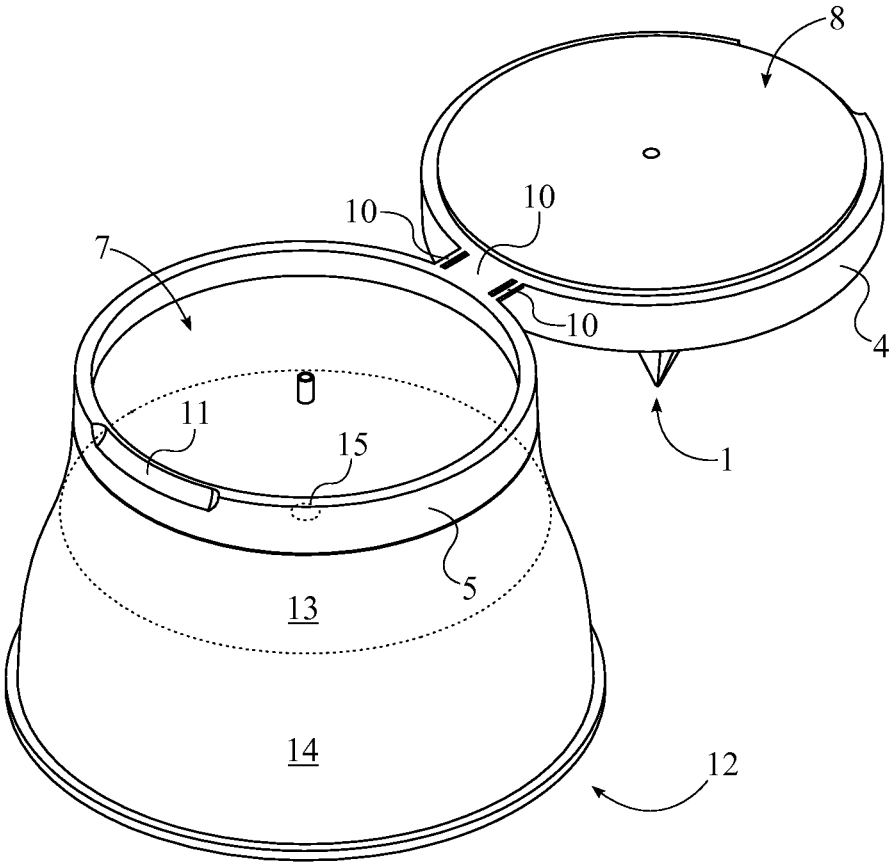
FIG. 3 is a top perspective view of the present invention, wherein the present invention is fully open.

A user presses the grip insert 1 into the back end of a golf putter's grip in order to properly secure the present invention to the golf putter. The grip insert 1 comprises a prong 2 and a plurality of barbs 3, which are shown in FIGS. 2 and 3. The prong 2 is an elongated member that traverses into and is situated within the back end of a golf putter's grip. The prong 2 is positioned adjacent to the first body 4 and is centrally connected on the first body 4, which allows for the rest of the present invention to be properly positioned on the back end of a golf putter. The plurality of barbs 3 is used to further secure the grip insert 1 within the back end of a golf putter's grip. The plurality of barbs 3 is angled away from the direction that the grip insert 1 traverses into the golf putter, which allows the grip insert 1 to resist movement out of the golf putter. The plurality of barbs 3 is connected along the prong 2, which allows the grip insert 1 to resist movement out of the golf putter for the entire length of the prong 2.

Once the grip insert 1 attaches the present invention to a golf putter, the suction cup 12 can be used to grasp a golf ball from a hard-to-reach place by turning the golf putter around and using the full length of the golf putter to fetch the golf ball. The suction cup 12 comprises a base portion 13, a flared annular portion 14, and a gripped hole 15. The base portion 13 is used to structurally stabilize the suction cup 12 while the suction cup 12 grasps and un-grasps a golf ball. The base portion 13 is positioned adjacent to the second body 5 and is concentrically connected to the second body 5, which allows the suction cup 12 to remain properly situated on the second body 5. The flared annular portion 14 is perimetrically connected to the base portion 13 opposite to the second body 5. The flared annular portion 14 is the means by which the suction cup 12 is able to grasp a golf ball because the flared annular portion 14 creates a negative fluid pressure between the suction cup 12 and the golf ball. The gripped hole 15 is used to hold the ball marker 16 within the suction cup 12 while the ball marker 16 is not being utilized. The gripped hole 15 is concentrically positioned with the flared annular portion 14 and traverses into the base portion 13, which allows the ball marker 16 to be held in place without disrupting the grasping function for the rest of the suction cup 12.

The locking mechanism 6 allows the first body 4 and the second body 5 to attach and detach from each other. The first body 4 needs to be engaged to the second body 5 while the present invention is being used to grasp a golf ball from a hard-to-reach place. Conversely, the second body 5 needs to be disengaged from the first body 4 while the present invention is being used to hold the grip of a golf putter off the ground. Thus, the present invention can be used to keep the grip of a golf putter clean from the dirt or moisture on the ground. As can be seen in FIGS. 2 and 3, the locking mechanism 6 comprises a first piece 7 and a second piece 8. The first piece 7 and the second piece 8 are mechanical components that are able engage and disengage each other upon user command. In order for the first body 4 and the second body 5 to attach or detach from each other, the first piece 7 and the second piece 8 must be properly configured onto the first body 4 and the second body 5. Thus, the first piece 7 is positioned adjacent to the first body 4 opposite to the grip insert 1 and is integrated to the first body 4. In addition, the second piece 8 is positioned adjacent to the second body 5 opposite to the suction cup 12 and is integrated to the second body 5. In the preferred embodiment of the present invention, the first piece 7 is a stubby protrusion with a center hole, and the second piece 8 is a stubby-protrusion-receiving cavity with a center rod.

When the first body 4 and the second body 5 are engaged to each other, the first body 4 and the second body 5 form a combined body. The combined body is beneficial to describe the positioning of the thumbnail opener 11 and the hinge 9. The thumbnail opener 11 and the hinge 9 are positioned in between the first body 4 and the second body 5 in order to control the present invention once the first piece 7 disengages from the second piece 8. The thumbnail opener 11 and the hinge 9 are positioned opposite to each other around the combined body. Consequently, a user can pull apart the second body 5 and the first body 4 with the thumbnail opener 11 from one side of the combined body, and the hinge 9 can guide the movement of the second body 5 from the other side of combined body. The thumbnail opener 11 is integrated into the first body 4 and the second body 5, which allows the combined body to have a more aesthetically pleasing appearance. In addition, the hinge 9 comprises a plurality of bands 10, and the hinge 9 specifically comprises three bands in the preferred embodiment of the present invention. The first body 4 and the second body 5 are hingedly connected by the plurality of bands 10. While the second piece 8 is disengaged from the first piece 7, the second body 5 can rotate about the hinge 9 at 180 degrees so that the second body 5 can press against the first body 4 and prop up the grip for a golf putter. The plurality of bands 10 allows the second body 5 to fully rotate about the hinge 9 and properly supports the second body 5 with the first body 4.

Figure 4:
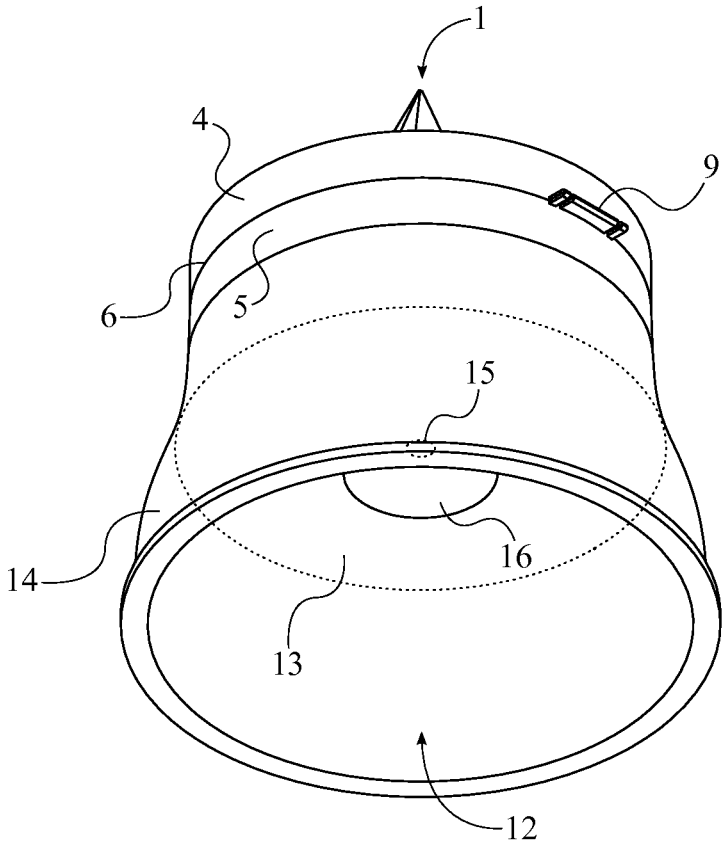
FIG. 4 is a bottom perspective of the present invention, wherein the ball marker is attached to the present invention.
Figure 5:
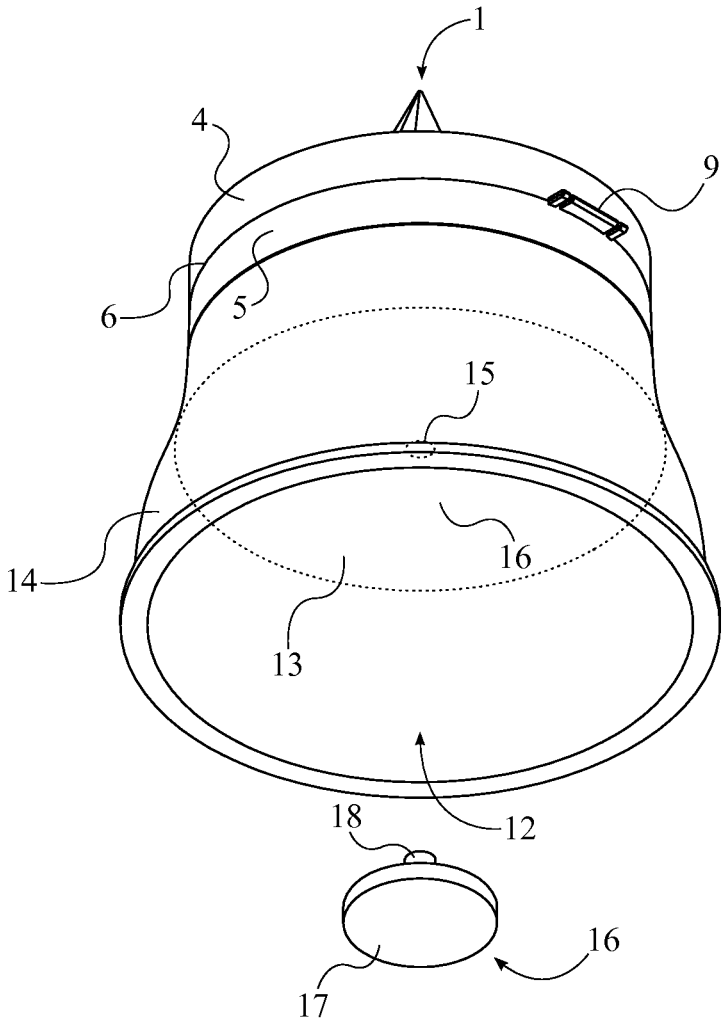
FIG. 5 is a bottom perspective of the present invention, wherein the ball marker is detached from the present invention.

The ball marker 16 can be tucked away on a convenient location on the present invention while the ball marker 16 is not being used, which is shown in FIG. 4. The ball marker 16 is positioned within the suction cup 12, which is the convenient location for the ball marker 16. The ball marker 16 comprises a flat tab 17 and a short stake 18. The flat tab 17 is a prominently visual piece of the ball marker 16, which allows a user to mark the location of their ball on a golf course. The short stake 18 is used to hold the ball marker 16 within the suction cup 12. The short stake 18 is centrally positioned with the flat tab 17 and is connected normal to the flat tab 17. The short stake 18 is positioned within the gripped hole 15 in order to situate and stabilize the ball marker 16 within the suction cup 12, which is shown in FIG. 5.

Although the invention has been explained in relation to its preferred embodiment, it is to be understood that many other possible modifications and variations can be made without departing from the spirit and scope of the invention as hereinafter claimed.

What is claimed is:

1. A golf putter attachment to lift golf balls and to prop up golf putters comprises:
- a grip insert;
- a first body;
- a second body;
- a locking mechanism;
- a hinge;
- a thumbnail opener;
- a suction cup;
- a ball marker;
- said grip insert comprises a prong and a plurality of barbs;
- said locking mechanism comprises a first piece and a second piece;
- said hinge comprises a plurality of bands;
- said suction cup comprises a base portion, a flared annular portion, and a gripped hole; and
- said ball marker comprises a flat tab and a short stake.

2. The golf putter attachment to lift golf balls and to prop up golf putters as claimed in claim 1 comprises:
- said prong being positioned adjacent to said first body;
- said prong being centrally connected onto said first body; and
- said plurality of barbs being connected along said prong.

3. The golf putter attachment to lift golf balls and to prop up golf putters as claimed in claim 1 comprises:
- said base portion being positioned adjacent to said second body;
- said base portion being concentrically connected to said second body;
- said flared annular portion being perimetrically connected to said base portion opposite to said second body;
- said gripped hole being concentrically positioned with said flared annular portion; and
- said gripped hole traversing into said base portion.

4. The golf putter attachment to lift golf balls and to prop up golf putters as claimed in claim 1 comprises:
- said first piece being positioned adjacent to said first body opposite to said grip insert;
- said first piece being integrated to said first body;
- said second piece being positioned adjacent to said second body opposite to said suction cup; and
- said second piece being integrated to said second body.

5. The golf putter attachment to lift golf balls and to prop up golf putters as claimed in claim 1 comprises:
- said first piece and said second piece being engaged to each other, wherein said first body and said second body form a combined body;
- said thumbnail opener and said hinge being positioned in between said first body and said second body; and
- said thumbnail opener and said hinge being positioned opposite to each other around said combined body.

6. The golf putter attachment to lift golf balls and to prop up golf putters as claimed in claim 5 comprises:
- said first body and said second body being hingedly connected by said plurality of bands; and
- said thumbnail opener being integrated into said first body and said second body.

7. The golf putter attachment to lift golf balls and to prop up golf putters as claimed in claim 1 comprises:
- said short stake being centrally positioned with said flat tab; and
- said short stake being connected normal to said flat tab.

8. The golf putter attachment to lift golf balls and to prop up golf putters as claimed in claim 7 comprises:
- said ball marker being positioned within said suction cup; and
- said short stake being positioned within said gripped hole.

9. A golf putter attachment to lift golf balls and to prop up golf putters comprises:
- a grip insert;
- a first body;
- a second body;
- a locking mechanism;
- a hinge;
- a thumbnail opener;
- a suction cup;
- a ball marker;
- said grip insert comprises a prong and a plurality of barbs;
- said locking mechanism comprises a first piece and a second piece;
- said hinge comprises a plurality of bands;
- said suction cup comprises a base portion, a flared annular portion, and a gripped hole;
- said ball marker comprises a flat tab and a short stake;

said prong being positioned adjacent to said first body;
said prong being centrally connected onto said first body;
said plurality of barbs being connected along said prong;
said base portion being positioned adjacent to said second body;
said base portion being concentrically connected to said second body;
said flared annular portion being perimetrically connected to said base portion opposite to said second body;
said gripped hole being concentrically positioned with said flared annular portion;
said gripped hole traversing into said base portion;
said first piece being positioned adjacent to said first body opposite to said grip insert;
said first piece being integrated to said first body;
said second piece being positioned adjacent to said second body opposite to said suction cup; and
said second piece being integrated to said second body.

10. The golf putter attachment to lift golf balls and to prop up golf putters as claimed in claim 9 comprises:
said first piece and said second piece being engaged to each other, wherein said first body and said second body form a combined body;
said thumbnail opener and said hinge being positioned in between said first body and said second body;
said thumbnail opener and said hinge being positioned opposite to each other around said combined body;
said first body and said second body being hingedly connected by said plurality of bands; and
said thumbnail opener being integrated into said first body and said second body.

11. The golf putter attachment to lift golf balls and to prop up golf putters as claimed in claim 9 comprises:
said short stake being centrally positioned with said flat tab;
said short stake being connected normal to said flat tab;
said ball marker being positioned within said suction cup; and
said short stake being positioned within said gripped hole.

12. A golf putter attachment to lift golf balls and to prop up golf putters comprises:
a grip insert;
a first body;
a second body;
a locking mechanism;
a hinge;
a thumbnail opener;
a suction cup;
a ball marker;
said grip insert comprises a prong and a plurality of barbs;
said locking mechanism comprises a first piece and a second piece;
said hinge comprises a plurality of bands;
said suction cup comprises a base portion, a flared annular portion, and a gripped hole;
said ball marker comprises a flat tab and a short stake;
said prong being positioned adjacent to said first body;
said prong being centrally connected onto said first body;
said plurality of barbs being connected along said prong;
said base portion being positioned adjacent to said second body;
said base portion being concentrically connected to said second body;
said flared annular portion being perimetrically connected to said base portion opposite to said second body;
said gripped hole being concentrically positioned with said flared annular portion;
said gripped hole traversing into said base portion;
said first piece being positioned adjacent to said first body opposite to said grip insert;
said first piece being integrated to said first body;
said second piece being positioned adjacent to said second body opposite to said suction cup;
said second piece being integrated to said second body;
said first piece and said second piece being engaged to each other, wherein said first body and said second body form a combined body;
said thumbnail opener and said hinge being positioned in between said first body and said second body; and
said thumbnail opener and said hinge being positioned opposite to each other around said combined body.

13. The golf putter attachment to lift golf balls and to prop up golf putters as claimed in claim 12 comprises:
said first body and said second body being hingedly connected by said plurality of bands;
said thumbnail opener being integrated into said first body and said second body;
said short stake being centrally positioned with said flat tab; and
said short stake being connected normal to said flat tab.

14. The golf putter attachment to lift golf balls and to prop up golf putters as claimed in claim 13 comprises:
said ball marker being positioned within said suction cup; and
said short stake being positioned within said gripped hole.

* * * * *